US010279879B2

(12) United States Patent
Viloria et al.

(10) Patent No.: US 10,279,879 B2
(45) Date of Patent: May 7, 2019

(54) MODULAR MARITIME TOW BODY

(71) Applicant: The Boeing Company, Chicago, IL (US)

(72) Inventors: Wayne Allen Viloria, Chino Hills, CA (US); Todd Patten, Mount Juliet, TN (US); Alexander Carter Vaughn, Huntington Beach, CA (US); Michael A. Carralero, Huntington Beach, CA (US); Christopher S. van Harmelen, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/675,507

(22) Filed: Aug. 11, 2017

(65) Prior Publication Data

US 2019/0047669 A1 Feb. 14, 2019

(51) Int. Cl.

| | |
|---|---|
| ***B63G 8/42*** | (2006.01) |
| ***B63G 8/00*** | (2006.01) |
| ***B63B 27/00*** | (2006.01) |

(52) U.S. Cl.

CPC ..... *B63G 8/42* (2013.01); *B63B 27/00* (2013.01); *B63G 8/001* (2013.01); *B63G 2008/007* (2013.01); *B63G 2008/425* (2013.01)

(58) Field of Classification Search

CPC ..... B63G 8/001; B63G 8/42; B63B 27/00
See application file for complete search history.

(56) References Cited

U.S. PATENT DOCUMENTS

| | | | | |
|---|---|---|---|---|
| 3,478,711 | A * | 11/1969 | Combs | B63B 21/62 114/244 |
| 5,690,041 | A * | 11/1997 | Hillenbrand | B63B 49/00 114/21.2 |
| 6,404,701 | B1 * | 6/2002 | Stottlemyer | G10K 11/008 367/106 |
| 6,918,627 | B2 | 7/2005 | Mataja et al. | |
| 8,336,479 | B2 | 12/2012 | Vosburgh et al. | |
| 2011/0011323 | A1 | 1/2011 | Wiggins et al. | |
| 2011/0139057 | A1 * | 6/2011 | Metcalf | B63B 15/00 114/343 |
| 2011/0162573 | A1 * | 7/2011 | Race | H01Q 1/04 114/328 |
| 2015/0234072 | A1 | 8/2015 | McConnell et al. | |
| 2017/0183069 | A1 * | 6/2017 | Sylvia | B63G 8/28 |

* cited by examiner

*Primary Examiner* — Stephen P Avila
(74) *Attorney, Agent, or Firm* — Yee & Associates, P.C.

(57) ABSTRACT

A tow body apparatus, a method of making a modular tow body, and a method of using a tow body. The tow body comprises a nose module, a tail module, and a first payload module that may be made of plastic by three-dimensional printing. The nose module is configured to be connected to a tow cable for towing the tow body through water and comprises a nose module mating interface. The tail module comprises fins for stabilizing the tow body as the tow body is towed through water and a tail module mating interface. The first payload module comprises an interior configured to hold a payload, a first mating interface configured to be attached alternatively to the nose module mating interface or to a second payload module, and a second mating interface configured to be attached alternatively to the tail module mating interface or to the second payload module.

20 Claims, 12 Drawing Sheets

MODULAR MARITIME TOW BODY

BACKGROUND INFORMATION

1. Field

The present disclosure relates generally to structures configured to be towed through water. More particularly, the present disclosure relates to a modular tow body comprising a plurality of interchangeable body sections. The present disclosure also relates to a method of making a modular tow body from a plastic material using three-dimensional printing. The present disclosure also relates to a method of using a modular tow body to transport and deploy a payload.

2. Background

A tow body may be any structure that is configured to be towed by a vehicle. For maritime applications, a tow body is configured to be towed through water. For example, without limitation, a tow body used for maritime applications may be towed through the water by a surface vessel, by a submarine, or by another appropriate vehicle. Such a tow body may be towed on the surface of the water or below the surface of the water.

A tow body may be used as a hydrodynamic housing for a payload that is to be towed through the water. Sensors, communication devices, various other electrical or mechanical devices, other appropriate devices or systems, or various combinations of devices and systems are examples of payloads that may be towed through the water inside of a tow body. In some cases, a payload may be towed to a desired location inside of a tow body and deployed from inside of the tow body into the water surrounding the tow body at the desired location.

The design and construction of a tow body may depend on such factors as the payload to be carried inside the tow body, whether or not a payload is to be deployed from the tow body, the mission to be performed by the tow body, other appropriate factors, or various combinations of factors. For example, without limitation, the size and shape of a tow body may be constrained by the size and number of payloads to be carried inside the tow body. In any case, it may be desirable that hydrodynamic characteristics of the tow body are taken into account and maximized as much as possible given other constraints, so that the tow body may move through the water with as little resistance as possible.

Currently, a tow body may be designed and fabricated to carry a specific payload, to perform a specific mission, or both to carry a specific payload and perform a specific mission. The ability to use such a tow body to carry other payloads or perform other missions may be severely limited. Furthermore, such a tow body may not be easily reconfigured, and thus may become useless as the payload or mission for which the tow body was designed changes.

Alternatively, a tow body may be designed and fabricated to carry a variety of payloads, or to perform a variety of missions, or to both carry a variety of payloads and perform a variety of missions. However, such a tow body may not be used effectively or efficiently in many cases. For example, without limitation, a tow body that is designed to be large enough to carry several payloads may be used to carry only one payload. However, such a tow body may be oversized for carrying only one payload and thus may not be as hydrodynamic as a tow body that is designed and fabricated to carry a single payload.

Therefore, there may be a need for a method and apparatus that take into account at least some of the issues discussed above, as well as other possible issues.

SUMMARY

In one illustrative embodiment, a tow body apparatus comprises a nose module, a tail module, and a first payload module. The nose module is configured to be connected to a tow cable for towing the tow body through water and comprises a nose module mating interface. The tail module comprises fins for stabilizing the tow body as the tow body is towed through the water and a tail module mating interface. The first payload module comprises an interior configured to hold a payload, a first mating interface configured to be attached alternatively to the nose module mating interface or to a second payload module, and a second mating interface configured to be attached alternatively to the tail module mating interface or to the second payload module.

In another illustrative embodiment, a method of making a modular tow body comprises making a nose module, a tail module, and a first payload module of plastic by three-dimensional printing. The nose module is configured to be connected to a tow cable for towing the tow body through water and comprises a nose module mating interface. The tail module comprises fins configured to stabilize the tow body as the tow body is towed through the water and a tail module mating interface. The first payload module comprises an interior configured to hold a payload, a first mating interface configured to be attached alternatively to the nose module mating interface or to a second payload module, and a second mating interface configured to be attached alternatively to the tail module mating interface or to the second payload module.

In yet another illustrative embodiment, a method of using a tow body comprises towing the tow body through water by a towing vehicle. The tow body comprises a nose module, a tail module, and a first payload module. The nose module is connected by a tow cable to the towing vehicle and comprises a nose module mating interface. The tail module comprises fins for stabilizing the tow body as the tow body is towed through the water and a tail module mating interface. The first payload module comprises an interior configured to hold a payload, a first mating interface configured to be attached alternatively to the nose module mating interface or to a second payload module, and a second mating interface configured to be attached alternatively to the tail module mating interface or to the second payload module.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and features thereof, will best be understood by reference to the following detailed description of one or more illustrative embodiments of the present disclosure when read in conjunction with the accompanying drawings, wherein:

DETAILED DESCRIPTION

The illustrative embodiments recognize and take into account different considerations. For example, the illustrative embodiments recognize and take into account that traditional tow body fabrication may require expensive molds or tooling and jigs. Moreover, existing tow body fabrication methods may be less efficient and more expensive than desired. Furthermore, production times for traditional tow body fabrication methods may be undesirably slow.

The illustrative embodiments provide for the three-dimensional printing fabrication of tow bodies. Three-dimensional printing fabrication in accordance with an illustrative embodiment allows tow bodies with complex geometries to be produced more quickly, with lower manufacturing costs, and with shorter lead times than with traditional fabrication methods. The higher the tow body complexity, the greater the advantage that three-dimensional printing fabrication of tow bodies in accordance with an illustrative embodiment has over conventional methods of tow body fabrication.

Three-dimensional printing fabrication of tow bodies in accordance with an illustrative embodiment is particularly well-suited for the development of prototypes, low volume, or custom tow bodies for maritime applications. Design changes are more easily incorporated, which facilitates the modularization of tow body payloads.

Three-dimensional printing fabrication of tow bodies in accordance with an illustrative embodiment allows tow bodies to be constructed with light-weight materials that reduce the drag of the tow bodies when towed through the water. Therefore, performance of the vehicle towing such a tow body made in accordance with an illustrative embodiment may be improved.

Figure 1:
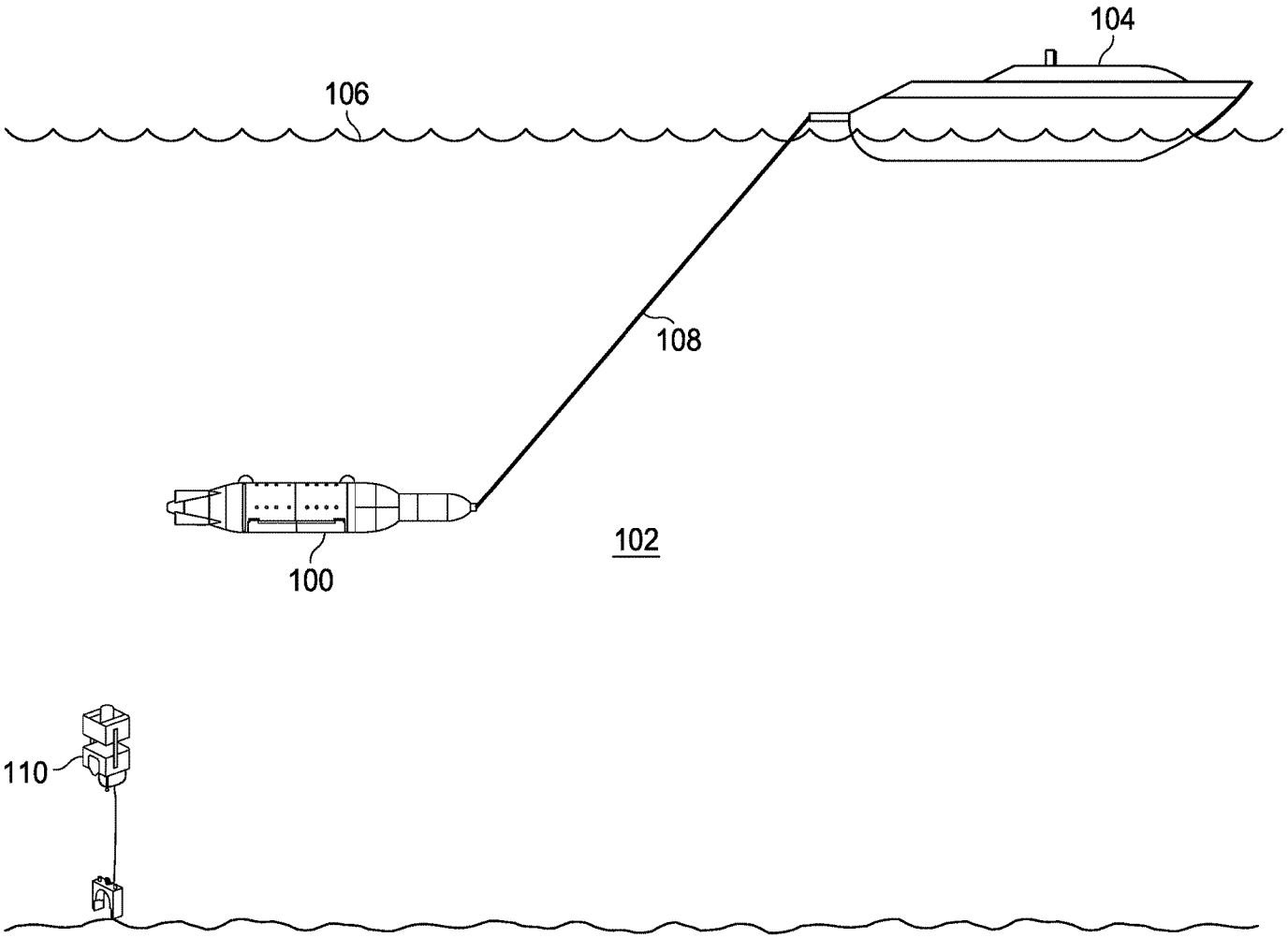
FIG. 1 is an illustration of a tow body in use in accordance with an illustrative embodiment.

Turning to FIG. 1, an illustration of a tow body in use is depicted in accordance with an illustrative embodiment. Tow body 100 in accordance with an illustrative embodiment may be configured to be towed through water 102 by towing vehicle 104. Water 102 may comprise any appropriate body of water in which it may be desirable to use tow body 100 for any appropriate purpose. Tow body 100 may be configured to be towed below surface 106 of water 102 or on surface 106 of water 102. Towing vehicle 104 may be configured to operate on surface 106 of water 102, below surface 106 of water 102, or above surface 106 of water 102. Towing vehicle 104 may be manned or unmanned. Tow body 100 may be connected to towing vehicle 104 by any appropriate tow cable 108.

Tow body 100 may be configured for any appropriate purpose or mission. For example, tow body 100 may be configured to hold any appropriate payload on the inside of tow body 100 when tow body 100 is being towed through water 102 by towing vehicle 104. For example, without limitation, a payload inside tow body 100 may comprise an electronic or other device that is operated while tow body is being towed through water 102 by towing vehicle 104.

Alternatively, or in addition, tow body 100 may be configured to carry and deploy deployable payload 110. Deployable payload 110 may be towed inside of tow body 100 to a desired location at which deployable payload 110 may be deployed from inside of tow body 100 into water 102 around tow body 100. For example, without limitation, deployable payload 110 may comprise an electronic or other device that is operated after deployable payload 110 is deployed from tow body 100. Tow body 100 also may include appropriate electronics on tow body 100 for processing information that may be transmitted from deployable payload 110 to such electronics on tow body 100 after deployable payload 110 is deployed from tow body 100.

Figure 2:
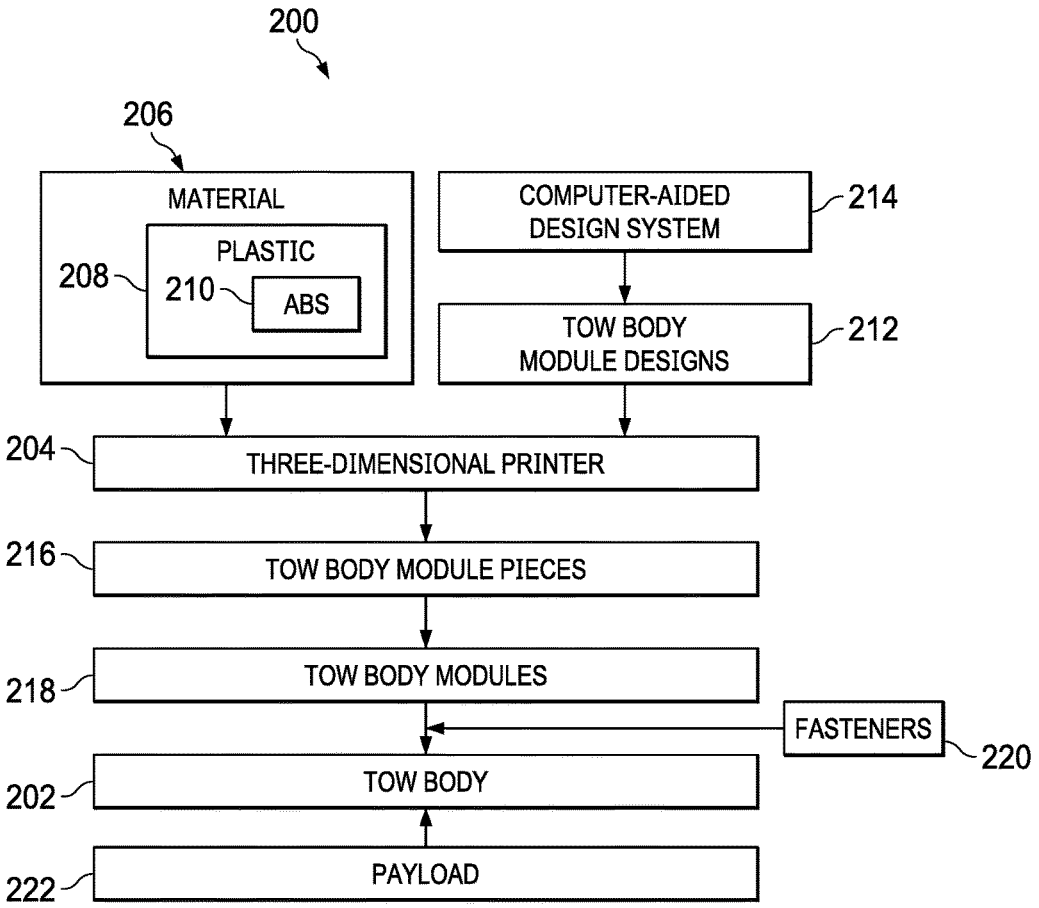
FIG. 2 is an illustration of a block diagram of a tow body fabrication system for making a tow body in accordance with an illustrative embodiment.

Turning to FIG. 2, an illustration of a block diagram of a tow body fabrication system for making a tow body is depicted in accordance with an illustrative embodiment. Tow body fabrication system 200 is configured to make tow body 202 by three-dimensional printing. Three-dimensional printing also may be referred to as additive manufacturing. Tow body 100 in FIG. 1 may be an example of tow body 202 made using tow body fabrication system 200.

Tow body fabrication system 200 may comprise any appropriate three-dimensional printer 204. Material 206 for making tow body 202 may be provided to three-dimensional printer 204. Material 206 may include any appropriate material that may be used by three-dimensional printer 204 to make tow body 202. For example, material 206 may comprise plastic 208 or any other appropriate material. Plastic 208 may include any appropriate plastic material that may be used by three-dimensional printer 204 to make tow body 202. For example, without limitation, plastic 208 may comprise ABS 210, acrylonitrile butadiene styrene, or any other appropriate plastic material.

Tow body module designs 212 also may be provided to three-dimensional printer 204. For example, without limitation, tow body module designs 212 may be developed using any appropriate computer-aided design system 214 to provide tow body module designs 212 in an appropriate format for use by three-dimensional printer 204.

Three-dimensional printer 204 may be operated in a known manner to produce from material 206 tow body module pieces 216 as defined by tow body module designs 212. Tow body module pieces 216 may be joined together in any appropriate manner to form tow body modules 218. For example, without limitation, tow body module pieces 216 may be joined together using appropriate fasteners or removal, non-permanent method, material, or structure or combination of methods, materials, or structures.

Tow body modules 218 may be joined together using any appropriate fasteners 220 to form tow body 202. Any appropriate payload 222 may be loaded inside of tow body 202.

The illustration of tow body fabrication system 200 in FIG. 2 is not meant to imply physical or architectural limitations to the manner in which illustrative embodiments may be implemented. Other components, in addition to or in place of the ones illustrated, may be used. Some components may be optional. Also, the blocks are presented to illustrate some functional components. One or more of these blocks may be combined, divided, or combined and divided into different blocks when implemented in an illustrative embodiment.

Figure 3:
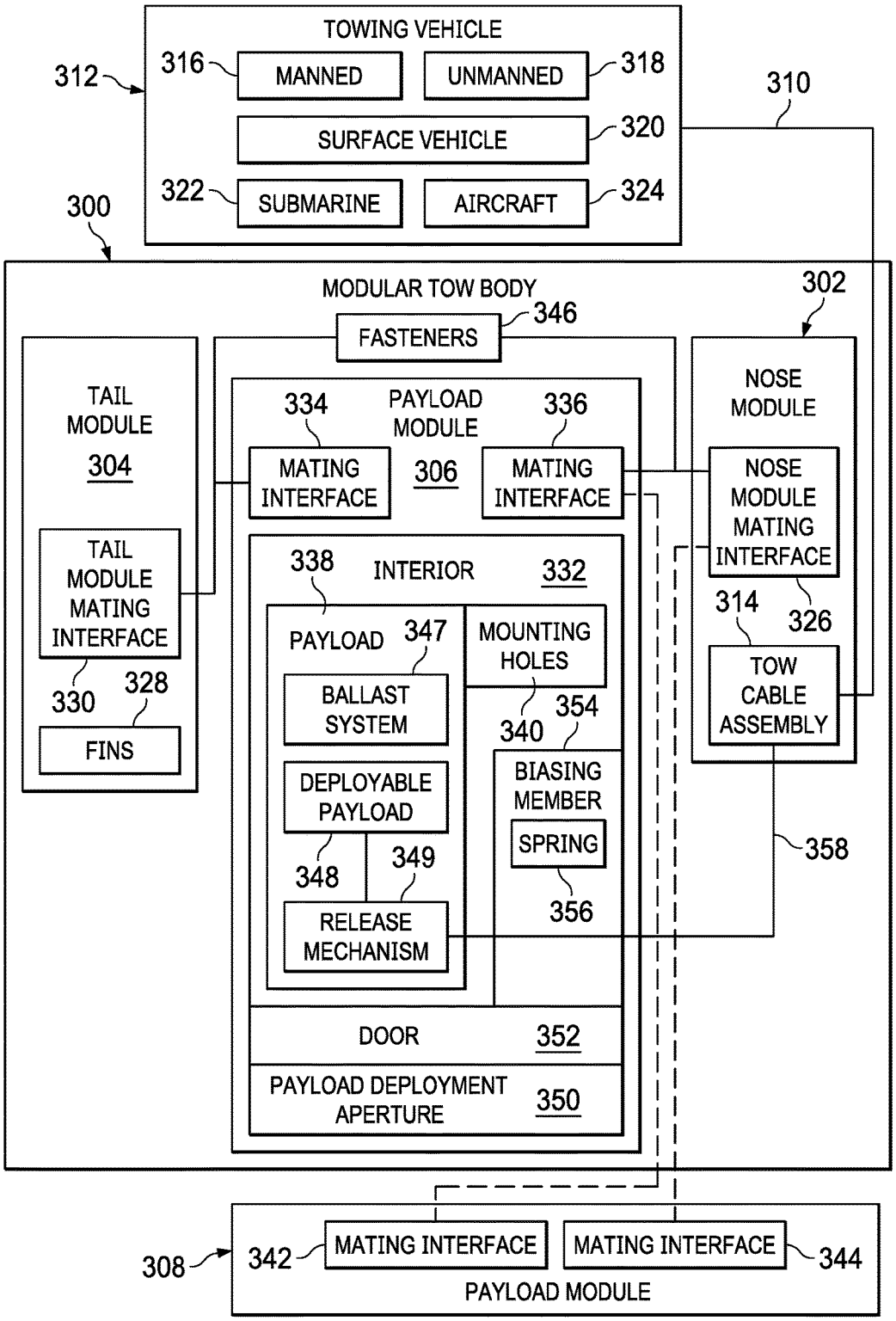
FIG. 3 is an illustration of a block diagram of a modular tow body in accordance with an illustrative embodiment.

Turning to FIG. 3, an illustration of a block diagram of a modular tow body is depicted in accordance with an illustrative embodiment. Modular tow body 300 may be an example of one implementation of tow body 202 in FIG. 2. Modular tow body 300 includes nose module 302, tail module 304, payload module 306, and payload module 308. Nose module 302, tail module 304, payload module 306, and payload module 308 may be examples of implementations of tow body modules 218 in FIG. 2.

Nose module 302 may be configured to be connected by tow cable 310 to towing vehicle 312. For example, nose module 302 may include tow cable assembly 314 for attaching tow cable 310 to nose module 302. Nose module 302 also may include nose module mating interface 326.

Towing vehicle 312 may comprise any appropriate vehicle or platform for towing modular tow body 300. Towing vehicle 312 may be manned 316 or unmanned 318. Towing vehicle 312 may be surface vehicle 320 configured to operate on the surface of water, submarine 322, or aircraft 324.

Tail module 304 may comprise fins 328 and tail module mating interface 330. Fins 328 may be configured for stabilizing modular tow body 300 as modular tow body 300 is towed through water by towing vehicle 312.

Payload module 306 may include interior 332, mating interface 334, and mating interface 336. Interior 332 may be configured to hold payload 338. For example, without limitation, payload 338 may be attached to mounting holes 340 provided in interior 332 of payload module 306. Payload module 306 may be referred to as a first payload module. Mating interface 336 may be referred to as a first mating interface. Mating interface 334 may be referred to as a second mating interface.

Payload module 308 may be referred to as a second payload module. Payload module 308 may be configured to hold a payload that is the same as or different from payload 338 in payload module 306. Payload module 308 may include mating interface 342 and mating interface 344. Mating interface 344 may be referred to as a third mating interface. Mating interface 342 may be referred to as a fourth mating interface.

Nose module mating interface 326, tail module mating interface 330, mating interface 334, mating interface 336, mating interface 342, and mating interface 344 may comprise common interfaces that are configured to be joined together in any appropriate combination. Therefore, the configuration of modules that comprise modular tow body 300 may be easily selected and changed because the common interfaces of the modules allows a variety of different combinations of modules to be connected together easily in a variety of different combinations.

The various modules forming modular tow body 300 may be attached together at the various mating interfaces using any appropriate fasteners 346. For example, without limitation, fasteners 346 may include bolts or any other appropriate fasteners or combination of fasteners.

Payload 338 may comprise any appropriate systems, devices, or structures that may be held in interior 332 of payload module 306. For example, without limitation, payload 338 may comprise ballast system 347, deployable payload 348, and release mechanism 349.

Deployable payload 348 may be deployed from interior 332 of payload module 306 through payload deployment aperture 350 to outside of payload module 306. Payload deployment aperture 350 may be covered by door 352. For example, without limitation, door 352 may be held in a closed position, thereby to close payload deployment aperture 350, by biasing member 354, such as spring 356.

Ballast system 347 may be configured to compensate for the change in buoyancy of modular tow body 300 when deployable payload 348 is deployed from payload module 306. Release mechanism 349 may be configured to release deployable payload 348 from interior 332 of payload module 306 in response to a release signal. For example, without limitation, the release signal and power for operation of release mechanism 349 may be provided from towing vehicle 312 via tow cable 310 to tow cable assembly 314. The release signal and power for operation of release mechanism 349 may be provided from tow cable assembly 314 to release mechanism 349 via line 358.

The illustration of modular tow body 300 in FIG. 3 is not meant to imply physical or architectural limitations to the manner in which illustrative embodiments may be implemented. Other components, in addition to or in place of the ones illustrated, may be used. Some components may be optional. Also, the blocks are presented to illustrate some functional components. One or more of these blocks may be combined, divided, or combined and divided into different blocks when implemented in an illustrative embodiment.

Figure 4:
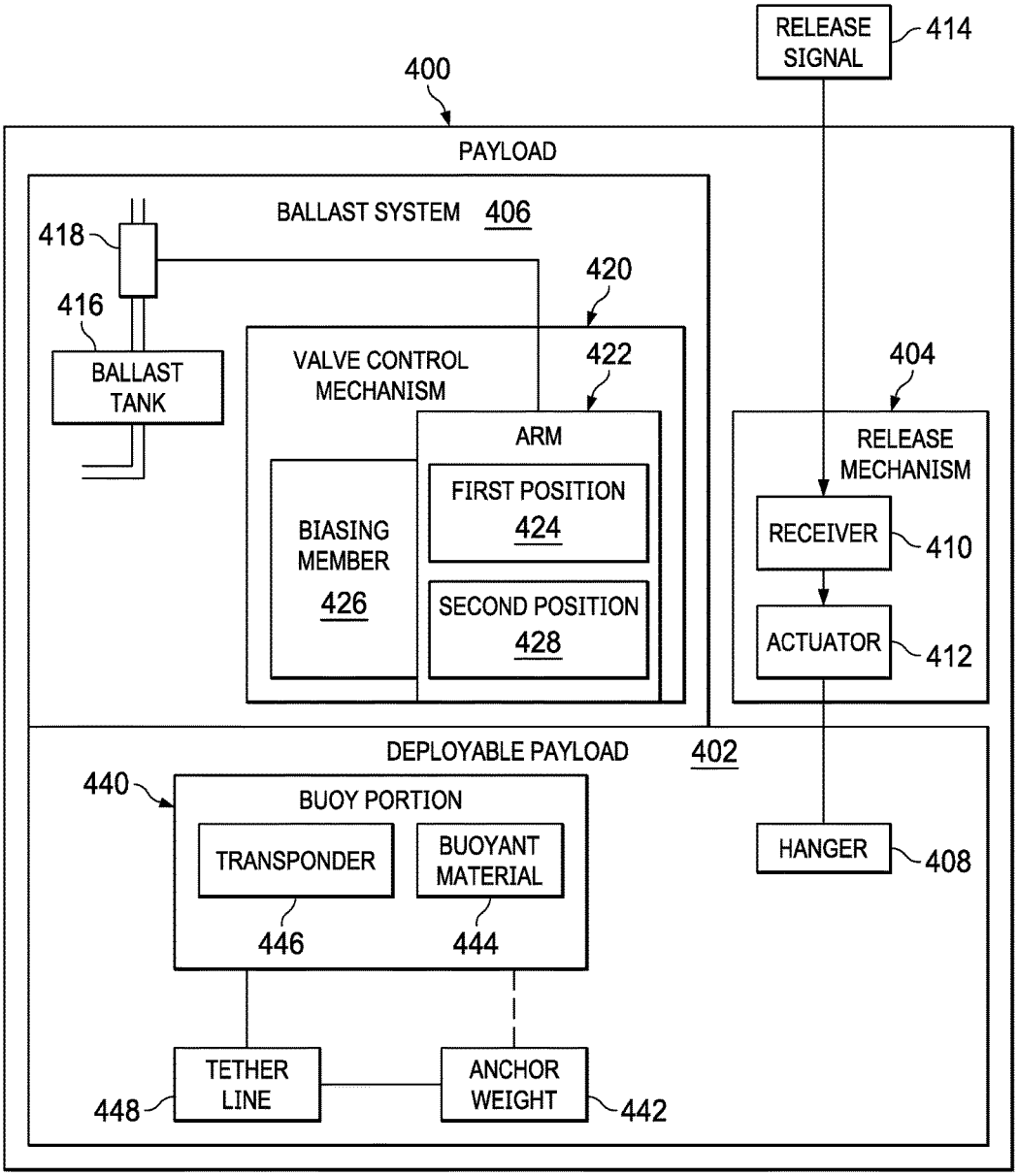
FIG. 4 is an illustration of a block diagram of a payload for a tow body in accordance with an illustrative embodiment.

Turning to FIG. 4, an illustration of a block diagram of a payload for a tow body is depicted in accordance with an illustrative embodiment. Payload 400 may include deployable payload 402, release mechanism 404, and ballast system 406. Deployable payload 402 may be attached to release mechanism 404 by hanger 408.

Release mechanism 404 may include receiver 410 and actuator 412. In response to receiving release signal 414 by receiver 410, actuator 412 may be activated to release deployable payload 402. Actuator 412 may be implemented in any appropriate manner. For example, without limitation, actuator 412 may comprise a solenoid.

Ballast system 406 may comprise ballast tank 416, valve 418, and valve control mechanism 420. Ballast system 406 may comprise any appropriate number of ballast tanks, valves, and valve control mechanisms.

Ballast tank 416 may be configured in any appropriate manner such that ambient water in which a tow body is operated is prevented from flowing into ballast tank 416 when valve 418 is closed and such that ambient water is allowed to flow into ballast tank 416 when valve 418 is open.

Valve 418 may be implemented in any appropriate manner. For example, without limitation, valve 418 may comprise a butterfly valve.

Valve control mechanism 420 may comprise arm 422 that is positioned in first position 424 in contact with deployable payload 402 before deployable payload 402 is released by release mechanism 404. Biasing member 426 may be configured to move arm 422 from first position 424 to second position 428 after deployable payload 402 is released and moves out of contact with arm 422. Arm 422 is coupled to valve 418 to open valve 418 when arm 422 moves to second position 428. When valve 418 is opened, water is allowed to enter into ballast tank 416 to compensate for the weight of deployable payload 402.

Deployable payload 402 may comprise buoy portion 440 and anchor weight 442. Buoy portion 440 may comprise buoyant material 444, such as buoyant foam. Buoy portion 440 also may include transponder 446 or another appropriate electronic device. Anchor weight 442 may be attached to buoy portion 440 by tether line 448.

The illustration of payload 400 in FIG. 4 is not meant to imply physical or architectural limitations to the manner in which illustrative embodiments may be implemented. Other components, in addition to or in place of the ones illustrated, may be used. Some components may be optional. Also, the blocks are presented to illustrate some functional components. One or more of these blocks may be combined, divided, or combined and divided into different blocks when implemented in an illustrative embodiment.

Figure 5:
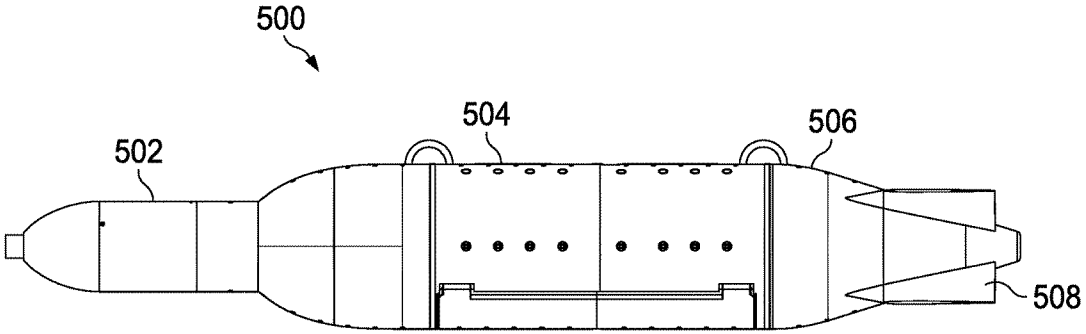
FIG. 5 is an illustration of a modular tow body comprising one payload module in accordance with an illustrative embodiment.

Turning to FIG. 5, an illustration of a modular tow body comprising one payload module is depicted in accordance with an illustrative embodiment. Modular tow body 500 may be an example of one implementation of modular tow body 300 in FIG. 3.

Modular tow body 500 may comprise nose module 502, payload module 504, and tail module 506. Nose module 502 may be configured to be connected to a tow cable for towing modular tow body 500 through water. Payload module 504 may be configured to hold any appropriate payload inside of payload module 504. Tail module 506 may comprise fins 508. Fins 508 may be configured to stabilize modular tow body 500 as modular tow body 500 is towed through water.

Figure 6:
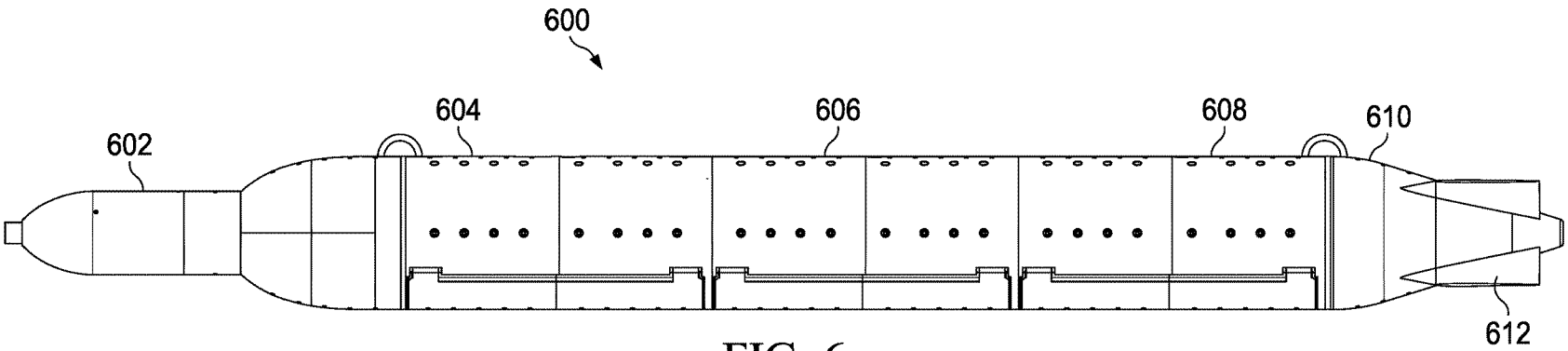
FIG. 6 is an illustration of a modular tow body comprising three payload modules in accordance with an illustrative embodiment.

Turning to FIG. 6, an illustration of a modular tow body comprising three payload modules is depicted in accordance with an illustrative embodiment. Modular tow body 600 may be an example of another implementation of modular tow body 300 in FIG. 3.

Modular tow body 600 may comprise nose module 602, payload module 604, payload module 606, payload module 608, and tail module 610. Nose module 602 may be configured to be connected to a tow cable for towing modular tow body 600 through water. Each of payload module 604, payload module 606, and payload module 608 may be configured to hold any appropriate payload. Payload module 604, payload module 606, and payload module 608 may be configured to hold the same payload or different payloads. Tail module 610 may comprise fins 612. Fins 612 may be configured to stabilize modular tow body 600 as modular tow body 600 is towed through water.

A modular tow body in accordance with an illustrative embodiment may comprise any appropriate number of payload modules. For example, without limitation, a modular tow body in accordance with an illustrative embodiment may comprise two payload modules or more than three payload modules.

Figure 7:
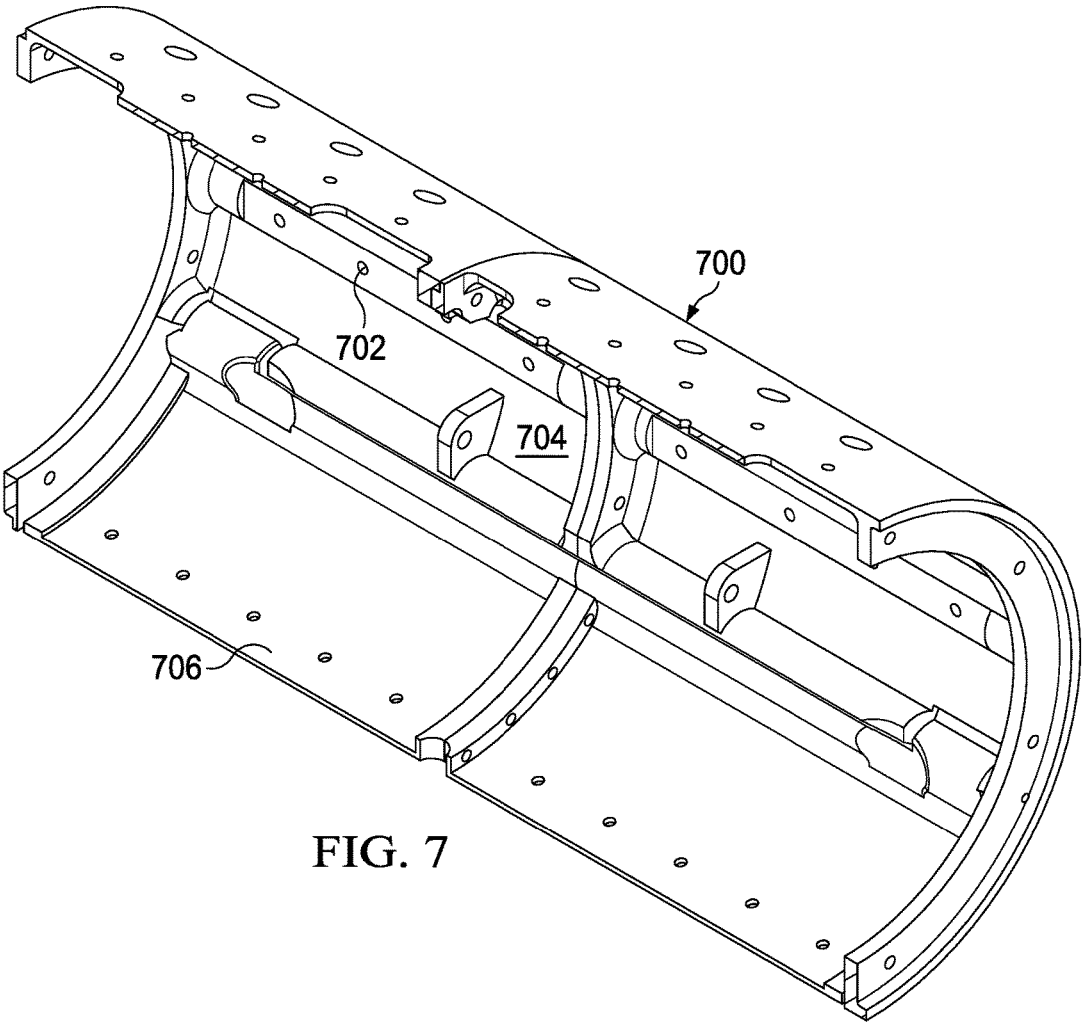
FIG. 7 is an illustration of a portion of a payload module for a modular tow body in accordance with an illustrative embodiment.

Turning to FIG. 7, an illustration of a portion of a payload module for a modular tow body is depicted in accordance with an illustrative embodiment. Payload module 700 may be an example of a portion of one implementation of payload module 306 in FIG. 3. Payload module 700 may be formed with mounting holes 702 on inside 704 thereof for attaching a payload to inside 704 of payload module 700. Payload module 700 may comprise door 706. For example, without limitation, door 706 may be configured to be held closed by a biasing member, such as a spring.

Turning to FIGS. 8-13, illustrations of the deployment of a deployable payload from a tow body are depicted in accordance with an illustrative embodiment. FIGS. 8-13 may illustrate an example of deploying deployable payload 348 from modular tow body 300 in FIG. 3. Payload 800 in FIGS. 8-13 may be an example of one implementation of payload 400 in FIG. 4.

Figure 8:
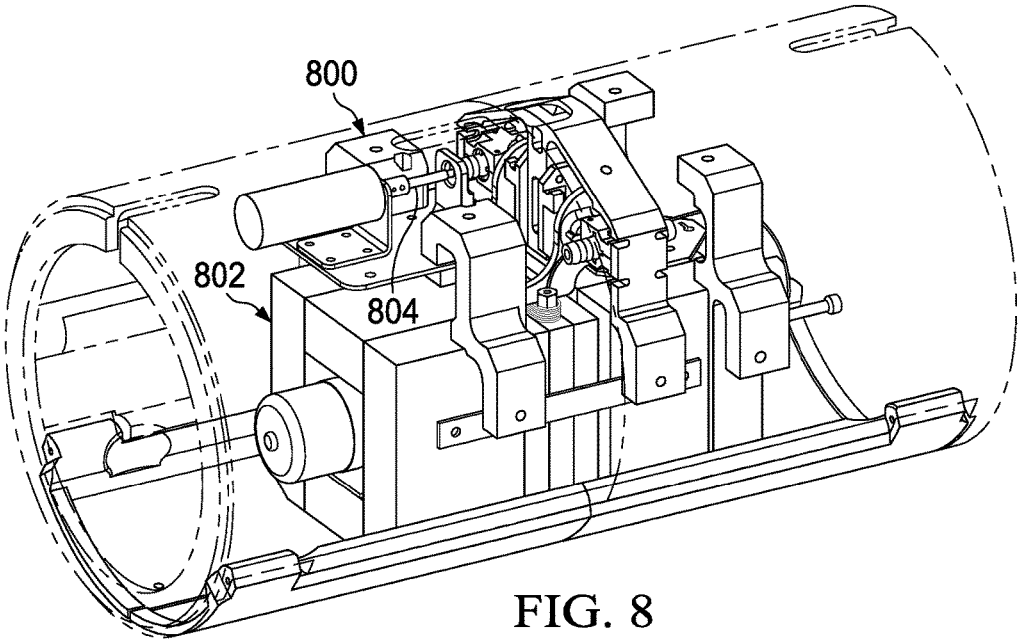
FIGS. 8-13 are illustrations of the deployment of a deployable payload from a tow body in accordance with an illustrative embodiment.

In FIG. 8, deployable payload 802 is shown in a position before being released by release mechanism 804.

Figure 9:
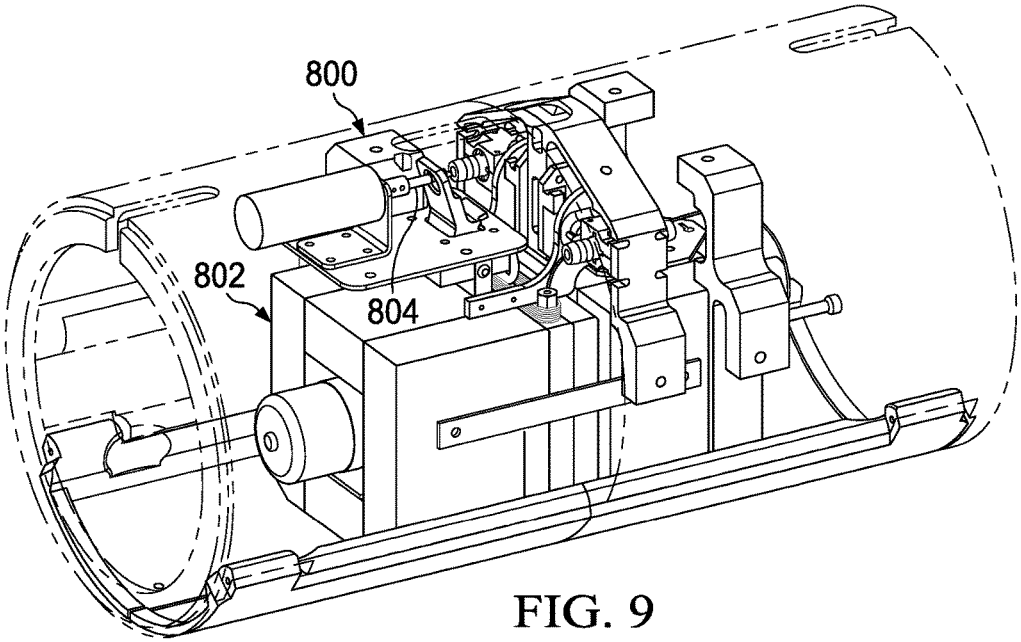

In FIG. 9, release mechanism 804 has been actuated in response to receiving a release signal to release deployable payload 802.

Figure 10:
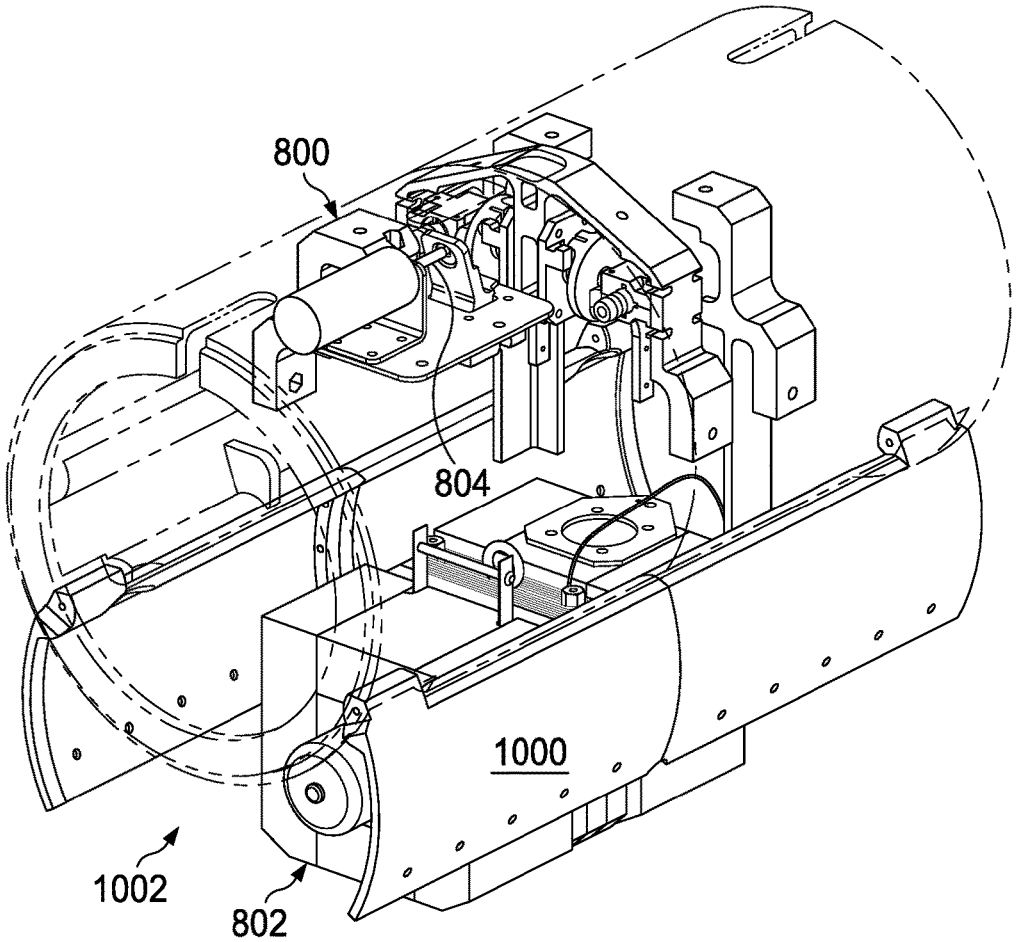

In FIG. 10, deployable payload 802 has pushed open doors 1000 and is moving to outside of a payload module through payload deployment aperture 1002.

Figure 11:
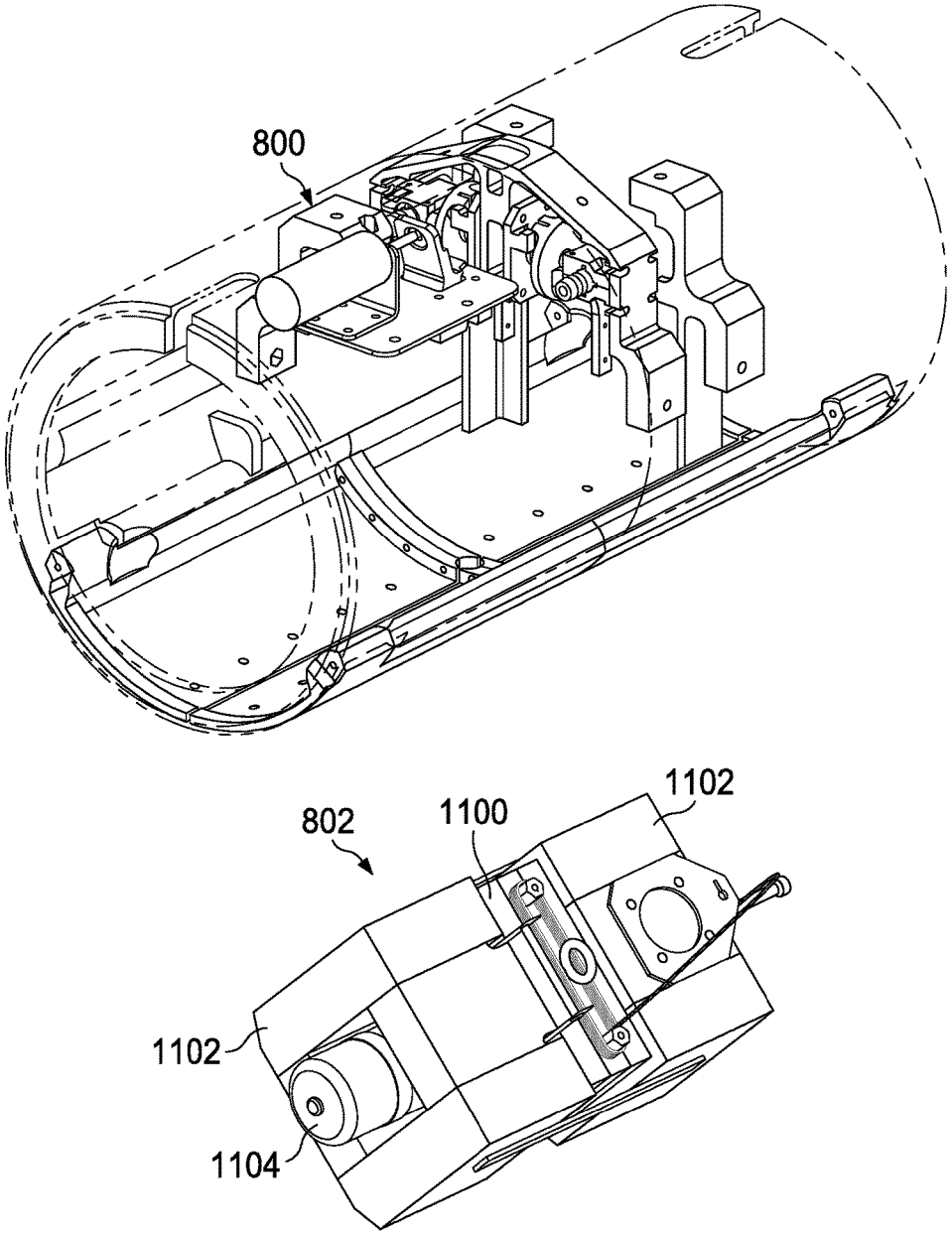

In FIG. 11, deployable payload 802 begins to rotate due to the unbalanced weight of anchor weight 1100 on deployable payload 802. In this example, deployable payload 802 also comprises buoyant material 1102 and transponder 1104.

Figure 12:
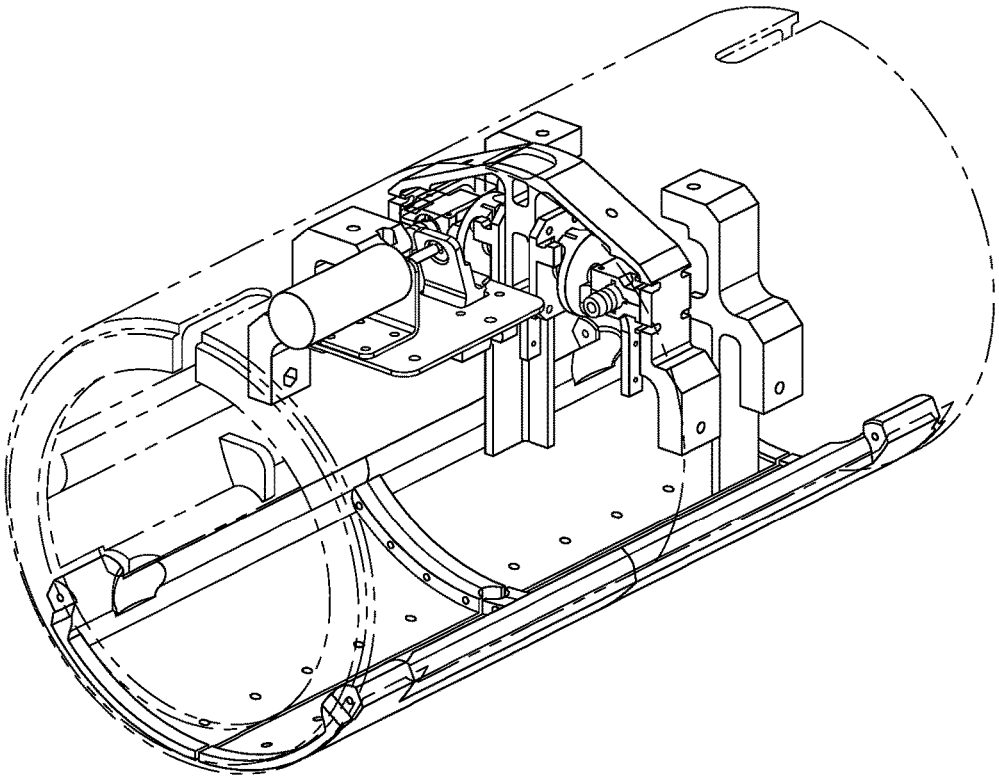
Figure 12:
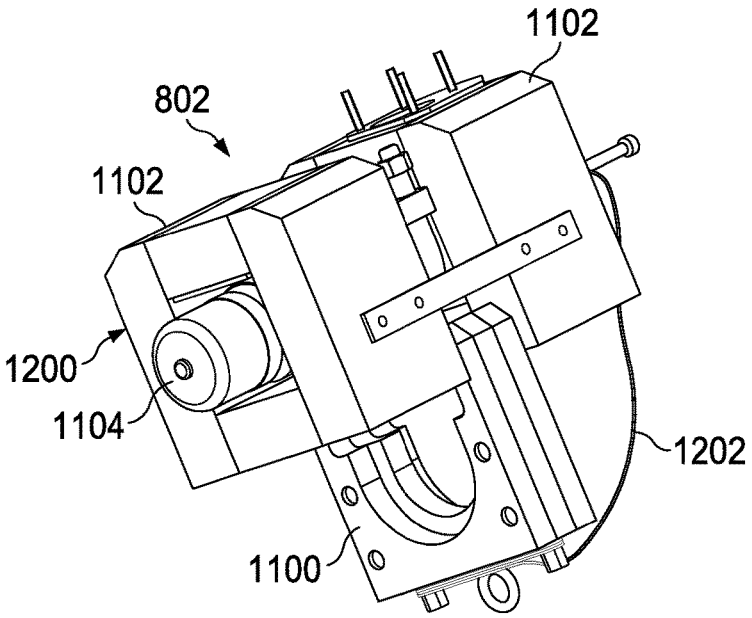

In FIG. 12, deployable payload 802 has rotated to a position where anchor weight 1100 begins to separate from buoy portion 1200 of deployable payload 802 comprising buoyant material 1102 and transponder 1104. Tether line 1202 connecting anchor weight 1100 to buoy portion 1200 begins to unwind.

Figure 13:
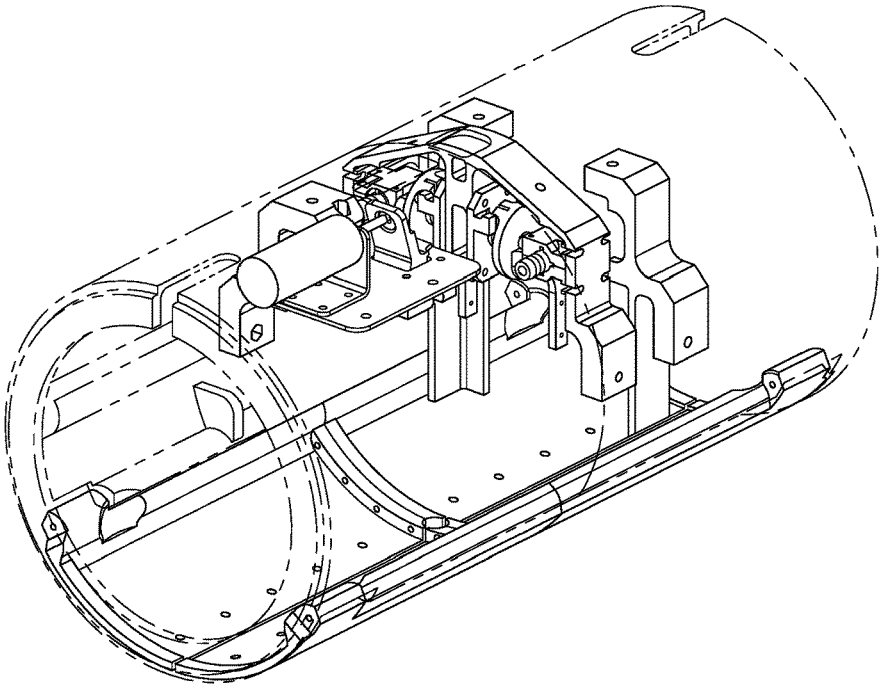
Figure 13:
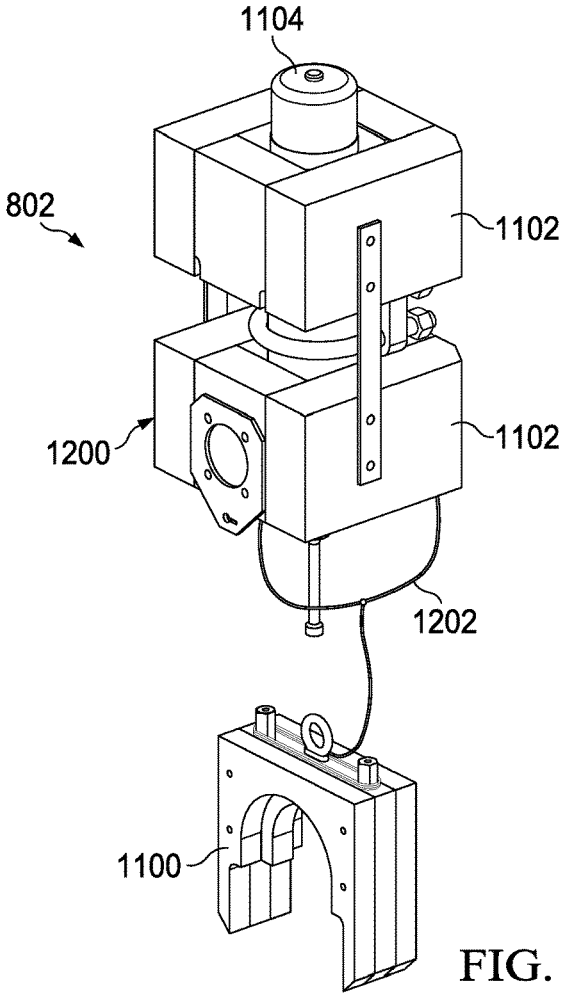

In FIG. 13, anchor weight 1100 has assumed its final orientation with respect to buoy portion 1200 and tether line 1202 unwinds further until deployable payload 802 is in its final operational position. Transponder 1104 then may begin operation.

Figure 14:
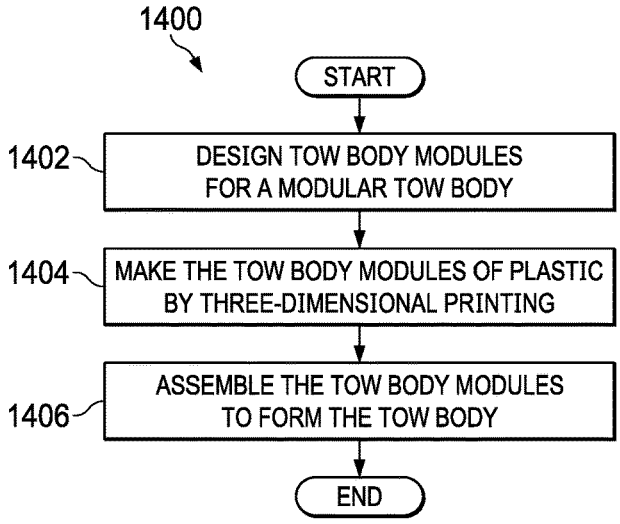
FIG. 14 is an illustration of a flowchart diagram of a process of making a modular tow body in accordance with an illustrative embodiment.

Turning to FIG. 14, an illustration of a flowchart diagram of a process of making a modular tow body is depicted in accordance with an illustrative embodiment. Process 1400 may be performed using tow body fabrication system 200 in FIG. 2.

Process 1400 may begin by designing tow body modules for a modular tow body (operation 1402). The tow body modules may then be made of plastic by three-dimensional printing (operation 1404). The tow body modules may then be assembled to form the tow body (operation 1406), with the process terminating thereafter.

Figure 15:
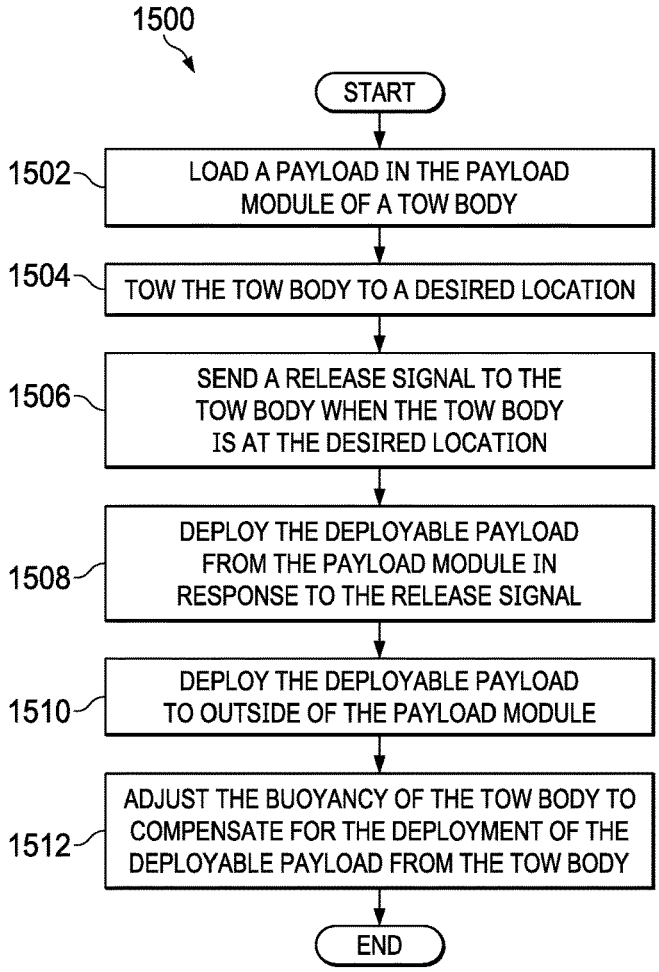
FIG. 15 is an illustration of a flowchart diagram of a process of using a tow body to deploy a deployable payload in accordance with an illustrative embodiment.

Turning to FIG. 15, an illustration of a flowchart diagram of a process of using a tow body to deploy a deployable payload is depicted in accordance with an illustrative embodiment. Process 1500 may be an example of a process of using modular tow body 300 to deploy deployable payload 348 in FIG. 3.

Process 1500 may begin with loading a payload in the payload module of a tow body (operation 1502). The tow body then may be towed to a desired location (operation 1504). A release signal may be sent to the tow body when the tow body is at the desired location (operation 1506). The deployable payload may be deployed from the payload module in response to the release signal (operation 1508). After being released, the deployable payload may be deployed to outside of the payload module (operation 1510). The buoyancy of the tow body may be adjusted to compensate for the deployment of the deployable payload from the tow body (operation 1512), with the process terminating thereafter.

For example, without limitation, process 1500 may be used to remotely distribute and survey a network of acoustic navigation transponders. In this case, process 1500 may be supported by software implemented in an appropriate data processing system. For example, without limitation, such software may support the command and control of an acoustic transceiver on a host platform through a well-defined interface. Such software also may support the autonomous determination of positioning and transponder release points. Furthermore, such software may support the autonomous determination of whether a transponder was released properly and is functioning properly following release. Such software may include algorithms to autonomously map transponder positions on the seafloor. The software also may include algorithms to determine an acoustic position of the host within a transponder network.

The flowcharts and block diagrams described herein illustrate the architecture, functionality, and operation of possible implementations of systems and methods according to various illustrative embodiments. It should be noted that the functions noted in a block may occur out of the order noted in the figures. For example, the functions of two blocks shown in succession may be performed substantially concurrently, or the functions of the blocks may sometimes be performed in the reverse order, depending upon the functionality involved. Furthermore, in some alternative implementations, the functions associated with some blocks in the flowcharts and block diagrams may be eliminated.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments and the practical application of such principles, and enable others of ordinary skill in the art to understand the disclosure for various embodiments with various modifications as may be suited to various uses and applications.

What is claimed is:

1. A tow body apparatus, that comprises:

a nose module configured to connect to a tow cable and tow the tow body through water, such that the nose module comprises a nose module mating interface;

a tail module that comprises:

fins configured to stabilize the tow body as the tow body moves through the water; and a tail module mating interface; and a first payload module that comprises:

an interior configured to hold a payload, such that the payload comprises:

a release mechanism configured to release, responsive to a release signal, a deployable payload from the interior; and a ballast system configured to change, responsive to a deployment of the deployable payload from the interior, a buoyancy of the tow body apparatus;

a first mating interface configured to be attached alternatively to the nose module mating interface or to a second payload module; and a second mating interface configured to be attached alternatively to the tail module mating interface or to the second payload module.

2. The tow body apparatus of claim 1, wherein the nose module, the tail module, and the first payload module each comprise three-dimensional printed plastic.

3. The tow body apparatus of claim 1, further comprising:

the second payload module comprising a third mating interface configured to attach alternatively to the nose module mating interface or to the first payload module; and a fourth mating interface configured to attach alternatively to the tail module mating interface or to the first payload module.

4. The tow body apparatus of claim 1, wherein the first payload module comprises:

a payload deployment aperture between the interior of the first payload module and an outside of the first payload module; and a door configured to close the payload deployment aperture when the door is closed and to open the payload deployment aperture when the door is open.

5. The tow body apparatus of claim 4, further comprising the payload in the interior of the first payload module, wherein the payload comprises the deployable payload configured to be deployed from the interior of the first payload module to the outside of the first payload module through the payload deployment aperture when the door is open.

6. The tow body apparatus of claim 5, further comprising:

a biasing member configured to hold the door closed;

the door configured to open by a push against the door from the deployable payload after the release mechanism releases the deployable payload; and the ballast system comprising: a ballast tank, a valve, and a valve control mechanism, wherein the valve control mechanism is in contact with the deployable payload when the deployable payload is in the interior of the first payload module, and wherein the valve control mechanism is configured to open the valve to allow water to enter the ballast tank through the valve in response to the deployable payload moving out of contact with the valve control mechanism.

7. The tow body apparatus of claim 5, wherein the deployable payload comprises:

a buoy portion comprising a buoyant material;

an anchor weight coupled to the buoy portion and configured to cause the deployable payload to rotate from a first position when the deployable payload is in the interior of the first payload module to a second position when the deployable payload is outside of the first payload module after being deployed from the first payload module; and the anchor weight configured to separate from the buoy portion when the deployable payload is in the second position.

8. A method of making a modular tow body, comprising:

making a nose module of plastic by three-dimensional printing, wherein the nose module is configured to be connected to a tow cable for towing the tow body through water and comprises a nose module mating interface;

making a tail module of plastic by three-dimensional printing, wherein the tail module comprises fins configured to stabilize the tow body as the tow body is towed through the water and a tail module mating interface; and making a first payload module of plastic by three-dimensional printing, wherein the first payload module comprises:

an interior configured to hold a payload comprising:

a release mechanism for releasing, responsive to a release signal, a deployable payload from the interior; and a ballast system for changing, in response to deploying the deployable payload from the interior, a buoyancy of the modular tow body;

a first mating interface configured to be attached alternatively to the nose module mating interface or to a second payload module; and a second mating interface configured to be attached alternatively to the tail module mating interface or to the second payload module.

9. The method of making the modular tow body of claim 8 further comprising:

attaching the first mating interface of the first payload module to the nose module mating interface using first fasteners; and attaching the second mating interface of the first payload module to the tail module mating interface using second fasteners.

10. The method of making the modular tow body of claim 8 further comprising:

making the second payload module of plastic by three-dimensional printing, wherein the second payload module comprises a third mating interface configured to be attached alternatively to the nose module mating interface or to the first payload module and a fourth mating interface configured to be attached alternatively to the tail module mating interface or to the first payload module;

attaching the first mating interface of the first payload module to the nose module mating interface using first fasteners; attaching the second mating interface of the first payload module to the third mating interface of the second payload module using second fasteners; and attaching the fourth mating interface of the second payload module to the tail module mating interface using third fasteners.

11. The method of making the modular tow body of claim 8, further comprising:

the first payload module comprising:

a payload deployment aperture between the interior of the first payload module and outside of the first payload module; and a door configured to close the payload deployment aperture when the door is closed and to open the payload deployment aperture when the door is open; and placing the payload in the interior of the first payload module, wherein the payload comprises the deployable payload configured to be deployed from the interior of the first payload module to outside of the first payload module through the payload deployment aperture when the door is open.

12. A method of using a tow body, comprising:

towing the tow body through water by a towing vehicle, wherein the tow body comprises:

a nose module connected by a tow cable to the towing vehicle and comprising a nose module mating interface;

a tail module comprising fins for stabilizing the tow body as the tow body is towed through the water and a tail module mating interface; and a first payload module comprising an interior configured to hold a payload, a first mating interface configured to be attached alternatively to the nose module mating interface or to a second payload module; and a second mating interface configured to be attached alternatively to the tail module mating interface or to the second payload module; and deploying a deployable payload from the interior of the first payload module to an outside of the first payload module through a payload deployment aperture after opening a door that opens the payload deployment aperture, between the interior of the first payload module and the outside of the first payload module, by the deployable payload pushing against the door after releasing the deployable payload from a release mechanism.

13. The method of using the tow body of claim 12, wherein the nose module, the tail module, and the first payload module are made of plastic by three-dimensional printing.

14. The method of using the tow body of claim 12, wherein the towing vehicle is selected from a group of towing vehicles consisting of: an unmanned surface vehicle, a manned surface vehicle, an unmanned submarine, a manned submarine, an unmanned aircraft, and a manned aircraft.

15. The method of using the tow body of claim 12 further comprising:

receiving a release signal by a release mechanism in the interior of the first payload module; and releasing the deployable payload from the interior of the first payload module by the release mechanism in response to receiving the release signal.

16. The method of using the tow body of claim 15, further comprising:

rotating the deployable payload from a first position when the deployable payload is in the interior of the first payload module to a second position when the deployable payload is outside of the first payload module after being deployed from the first payload module; and separating an anchor weight from a buoy portion of the deployable payload comprising buoyant material when the deployable payload is in the second position.

17. The method of using the tow body of claim 15 further comprising:

changing a buoyancy of the tow body by opening a valve to allow water to enter a ballast tank in the interior of the first payload module through the valve in response to deployment of the deployable payload from the interior of the first payload module to the outside of the first payload module.

18. The method of using the tow body of claim 17, wherein the valve is held closed by a valve control mechanism that is in contact with the deployable payload when the deployable payload is in the interior of the first payload module, and wherein opening the valve comprises opening the valve by the valve control mechanism in response to the deployable payload moving out of contact with the valve control mechanism.

19. The tow body of claim 1, further comprising the deployable payload comprising an anchor weight mounted within a buoy portion of the deployable payload, such that a tether line connects the anchor weight to the buoy portion.

20. The method of claim 8, further comprising connecting an anchor weight to a buoy portion of the deployable payload by a tether line.

* * * * *